United States Patent [19]

Wood

[11] Patent Number: 4,561,332

[45] Date of Patent: Dec. 31, 1985

[54] TORQUE WRENCH

[75] Inventor: Harold L. Wood, Lower Templestowe, Australia

[73] Assignee: Repco Limited, Melbourne, Australia

[21] Appl. No.: 574,331

[22] Filed: Jan. 27, 1984

[30] Foreign Application Priority Data

Jan. 27, 1983 [AU] Australia ..... PF7799

[51] Int. Cl.[4] ..... B25B 23/142

[52] U.S. Cl. ..... 81/479; 73/862.26

[58] Field of Search ..... 81/467, 478, 479, 480, 81/481, 482, 483; 73/862.26

[56] References Cited

U.S. PATENT DOCUMENTS 3,537,997 1/1951 Hattan ..... 81/479

3,664,186 5/1972 Kraus ..... 73/862.26

FOREIGN PATENT DOCUMENTS 732738 3/1943 Fed. Rep. of Germany ..... 81/479

*Primary Examiner*—James L. Jones, Jr.

*Attorney, Agent, or Firm*—Stevens, Davis, Miller & Mosher

[57] ABSTRACT

A torque wrench having a reaction bar and an arm extending laterally in the same direction from a work engaging head. The arm is flexed in response to torque applied to the head through the bar and cooperable members on the bar and arm respectively engage as a consequence of that flexing. The member on the bar is a pivoted lever which responds to the aforementioned engagement to swing towards a signal generating position at which it causes a switch to operate to close a circuit contained within a handle part of the bar. The circuit includes audible and visible signal means and those means are energized while the circuit remains closed. The switch is normally urged towards a circuit closed position but is prevented from reaching that position by a blocking member, and the aforementioned pivoted lever renders that blocking member inoperative when the pivoted lever is swung into its signal generating position. Thus, the signals continue to be generated until the pivoted lever is moved back from the signal generating position. Lost motion means functions to allow some relative movement between the pivoted lever and blocking member.

12 Claims, 8 Drawing Figures

TORQUE WRENCH

This invention relates to torque wrenches of the kind which provide a signal when a predetermined torque or tension has been reached. Such wrenches are used in a variety of situations and are generally adjustable to enable variation of the torque at which the signal is generated.

Torque wrenches of the aforementioned kind generally rely on an audible signal which is momentary in that it does not continue if the triggering or predetermined torque has been exceeded. The signal generating means is usually mechanical in nature and produces a sharp sound when the predetermined torque has been reached, but must be manually reset for subsequent operation. Such wrenches are not reliable in use either because the user does not detect the signal or because the signal generating means was not reset after the last operation.

In recent times attempts have been made to improve upon the accuracy and reliability of such torque wrenches by using electrical means to generate the predetermined torque signal. An example of such a wrench is disclosed by U.S. Pat. No. 4,226,127. The wrench of that patent however, still suffers one of the objectionable characteristics of the prior mechanical signal wrenches in that the torque signal does not continue after the predetermined torque has been reached.

It is an object of the present invention to provide a torque wrench of the aforementioned kind which is of relatively simple construction and incorporates signal generating means which remains operative after the predetermined torque has been reached. That is, the signal continues while the predetermined torque, or a greater torque is applied to the wrench.

According to one aspect of the present invention, there is provided a torque wrench including, a reaction bar, a work engaging head secured to an end of said bar, a handle at the end portion of said bar remote from said head, a pair of cooperable members attached to said head and bar respectively and being engagable as a consequence of said bar flexing under torque applied to said head through said bar, one said cooperable member being movable in response to said engagement so as to adopt a signal generating position, an electrical circuit including signal generating means, and actuator means responsive to said movable member adopting said signal generating position to cause said circuit to close and thereby generate a signal and maintaining said circuit closed until said movable member moves away from said signal generating position.

According to a further aspect of the invention, there is provided a torque wrench including a reaction bar, a work engaging head secured to one end of said bar, an arm secured to said head and extending laterally therefrom in substantially the same direction as said bar, an electrical circuit carried by said bar and including signal generating means, an actuator switch operable to close said circuit and thereby cause said signal generating means to generate a signal, means urging said switch towards a circuit closed position, blocking means operable to prevent movement of said switch into the circuit closed position, a triggering member mounted on said arm, a responder member pivotally mounted on said bar so as to be engagable with said triggering member and thereby caused to pivot relative to said bar towards a signal generating position at which it renders said blocking means inoperable, said engagement of the members occurring as a result of said bar flexing in response to torque applied to said head through said bar, and said actuator switch is operative to maintain the circuit closed until responder member is able to move back from said signal generating position.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

IN THE DRAWINGS

Figure 1:
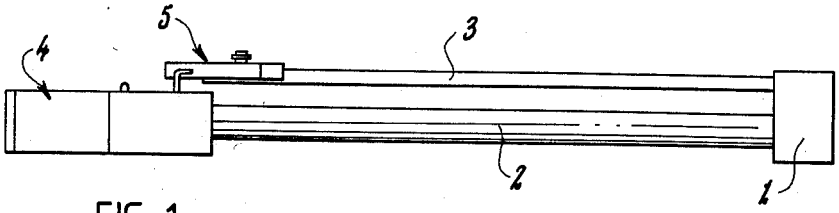
FIG. 1 is a semi diagrammatic side elevational view of one form of torque wrench incorporating an embodiment of the present invention.
Figure 2:
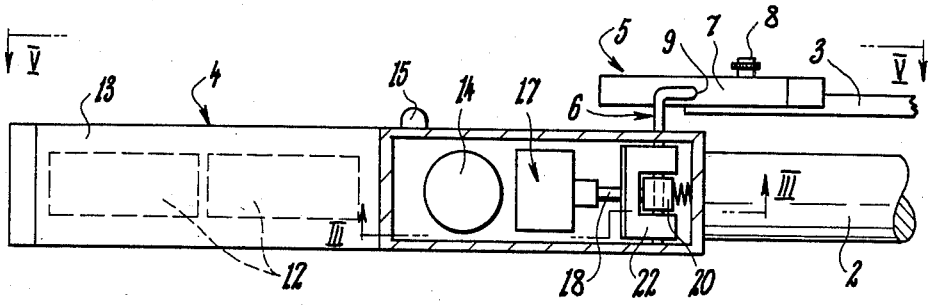
FIG. 2 is an enlarged view of part of the wrench shown in FIG. 1 and which has been partially sectioned so as to show internal components.
Figure 3:
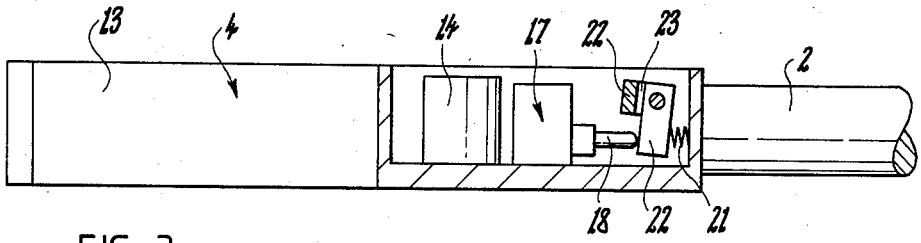
FIG. 3 is a cross sectional view taken along line III—III of FIG. 2.
Figure 4:
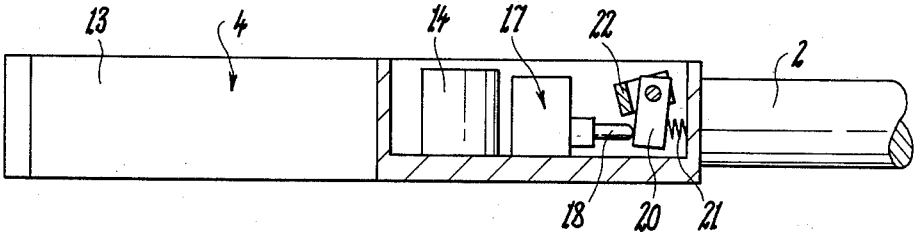
Figure 5:
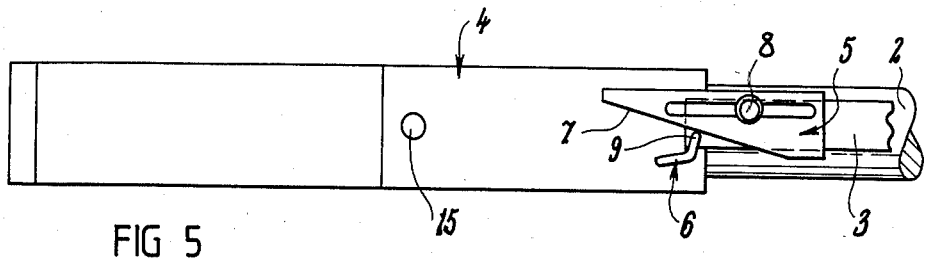
Figure 6:
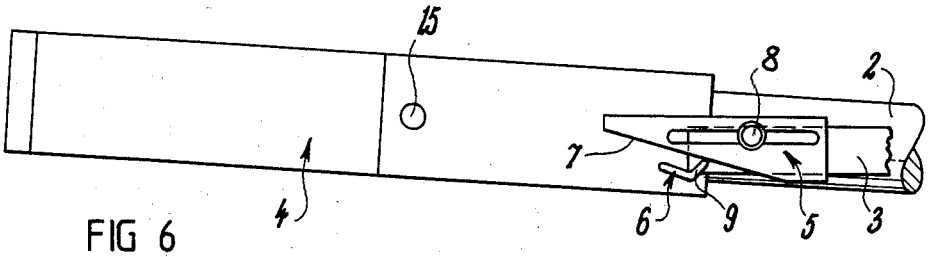
Figure 7:
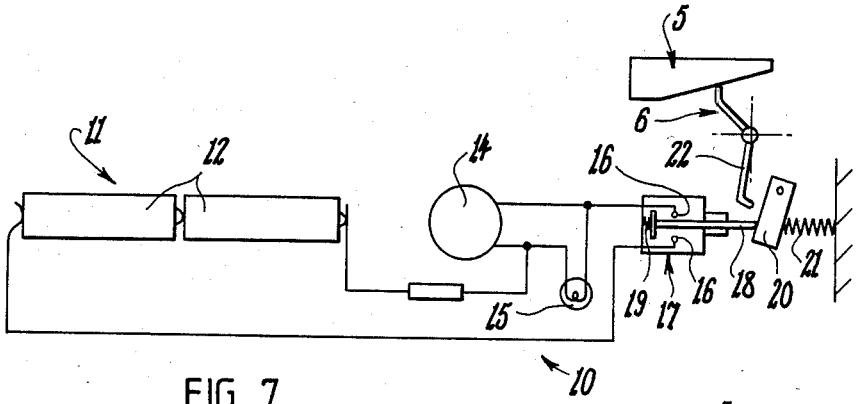
Figure 8:
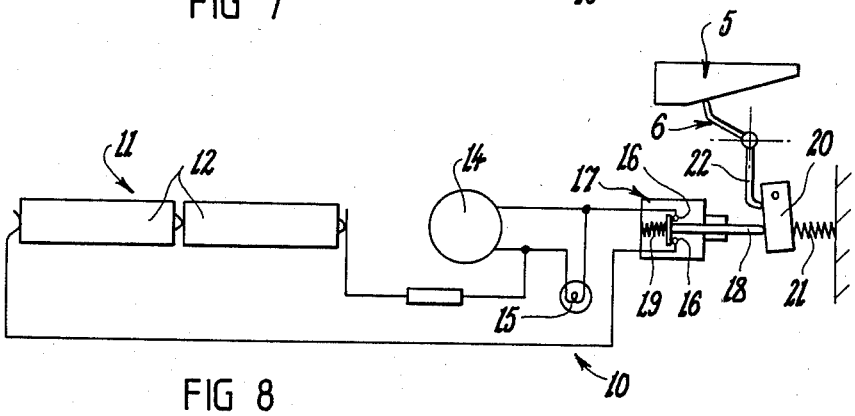

FIG. 4. is a view similar to FIG. 3 but showing the condition of internal components after the wrench has been partially tensioned;

FIG. 5 is a view taken along line V—V of FIG. 2;

FIG. 6 is a view similar to FIG. 5 but showing the wrench in a tensioned condition at which the signal generating means is energized;

FIG. 7 is a diagrammatic view of the circuit and some of the components of the wrench shown in FIG. 1 and in which the wrench is in a non-tensioned condition;

FIG. 8 is a view similar to FIG. 7 but showing the condition reached when the wrench has been tensioned;

The invention may be applied to wrenches of various forms, but it will be convenient to describe it with particular reference to a wrench of the reaction bar kind as shown in the drawings. The example wrench shown has a head 1 which may carry a socket or other tool, a torque applying reaction bar 2 and a fixed arm 3. The bar 2 and arm 3 are each connected to the head 1 and extend laterally therefrom in the same general direction. When the wrench is in use, the operating force is applied to an outer end portion or handle 4 of the reaction bar 2 and that bar 2 flexes or bends as the resistance to the operating or turning force increases. Such flexing or bending results in a change in the space or relationship between adjacent parts of the reaction bar 2 and the fixed arm 3 and that characteristic is employed in generating the desired signal.

In the form shown, a signal triggering member 5 is carried by an outer portion of the fixed arm 3 and is adapted to coact with a responder 6 carried by an adjacent part of the reaction bar 2. The positions of those members could be reversed however, so that the triggering member 5 is on the reaction bar 2 and the responder 6 is on the fixed arm 3. The triggering member 5 is mounted on the fixed arm 3 for movement in the longitudinal direction of the arm 3 and has a sloping ramp surface 7 which faces an adjacent part of the responder 6. A clamp screw 8 or other means may be used to secure the triggering member 5 in a selected position and a scale (not shown) provided on the fixed arm 3 or reaction bar 2 may indicate the positions at which the triggering member 5 will cause generation of the signal for various applied torques.

The responder 6 is preferably in the form of a lever pivotally mounted on the reaction bar 2 so that an end portion 9 is engagable by the ramp surface 7 of the triggering member 5. The arrangement is such that the responder lever 6 moves about its pivotal axis in response to relative movement between the adjacent outer end portions of the reaction bar 2 and fixed arm 3 (see FIGS. 5 and 6).

It is also preferred that the responder lever 6 is mounted on the handle 4 of the reaction bar 2, and that the handle 4 is hollow and contains a signal generating circuit 10 and a power source 11 (FIG. 7). The power source 11 may comprise one or more batteries 12 as shown—e.g., dry cell torch batteries—located in a terminal end section 13 of the handle 4. The batteries 12 form part of the circuit 10 which may also include a buzzer 14 or other audible signal generator and/or a light 15 which is exposed or visible at an external surface of the handle 4. The circuit 10 is closed and opened through connection and dis-connection of a pair of contacts 16 (FIGS. 7 and 8) and it is prefereed that those contacts 16 form part of a suitable switch 17 which is included in the circuit 10 and is arranged to be operated by the responder lever 6. In the example shown, the lever 6 is adapted to cause depression or release of a plunger 18 of the switch 17, according to the direction of pivotal movement of the lever, and the switch 17 is a micro-switch.

With the foregoing arrangement, the triggering member 5 can be secured at a position appropriate to cause generation of the signal at a particular torque. That is, as the predetermined torque is approached the responder lever 6 swings to release the micro-switch plunger 18 from the position shown in FIGS. 5 and 7 towards the position shown in FIGS. 6 and 8. At the later position of the lever 6, the plunger 18 is moved by an associated spring 19 to a position at which it closes the switch 17 and thereby causes a signal to be generated indicating that the predetermined torque has been reached. If pressure is maintained on the wrench so that the predetermined torque is maintained or exceeded, the signal will continue to be generated because of the fact that the signal generating circuit 10 remains closed. The signal will cease only after pressure has been released to allow the responder lever 6 to pivot back beyond the position at which it causes closing of the micro-switch 17.

The micro-switch 17 preferably operates to close the circuit 10 by release of the switch plunger 18 as shown, rather than depression, since that avoids the possibility of the switch 17 being overloaded under conditions of use. In the arrangement shown, the switch plunger 18 is engaged by an actuator lever 20 which is pivotally connected to the reaction bar handle 4 and is influenced by a spring 21 to move in a direction to depress the switch plunger 18. A striker member 22 is connected to the responder lever 6 to turn therewith and is arranged to engage the actuator lever 20 as shown in FIG. 4, to cause release of the switch plunger 18 as the preselected torque is approached. In an alternative arrangement (not shown), the responder lever 6 may be connected directly to or form part of the actuator lever 20, but it is generally preferred to provide for some degree of lost motion between the responder lever 6 and the actuator lever 10 and that is represented by the space 23 shown in FIG. 3. In the preferred arrangement shown, the two levers 6 and 20 swing about the same axis.

It will be appreciated from the foregoing description that the present invention provides an extremely simple yet effective signal generating system for a torque wrench. A torque wrench according to the invention can be accurately set to generate a signal at a predetermined torque and continuance of that signal minimises the possibility of the predetermined torque being exceeded to any substantial degree. The wrench has the further advantage that there is no need to reset the signal generating means after each use.

Various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. A torque wrench including, a reaction bar, a work engaging head secured to an end of said bar, a handle at the end portion of said bar remote from said head, a pair of cooperable members attached to said head and bar respectively and being engageable as a consequence of said bar flexing under torque applied to said head through sdid bar, one said cooperable member being movable in response to said engagement so as to adopt a signal generating position, an electrical circuit including signal generating means, actuator means responsive to said movable member adopting said signal generating position to cause said circuit to close and thereby generate a signal and maintaining said circuit closed until said movable member moves away from said signal generating position, said actuator means including a switch having a plunger which is axially movable between positions at which it causes said circuit to open and close respectively, and a pivoted lever which is spring influenced into engagement with said plunger to thereby prevent movement of aaid plunger into the circuit closed position, and said movable member is operable to engage said actuator lever and move it against its spring influence to allow said plunger to adopt the circuit closed position.

2. A torque wrench according to claim 1, wherein lost motion means is provided between said movable member and said actuator means so that said actuator means does not respond to a first part of the movement of said movable member towards said signal generating position.

3. A torque wrench according to claim 1, wherein the non-movable member is adjustably mounted to allow variation in the degree of said flexing necessary to cause said engagement of the members.

4. A torque wrench according to claim 1, wherein said movable member includes a pivotally mounted responder lever and a striker secured to that lever for movement therewith, and said striker is arranged to engage said actuator lever in response to pivotal movement of said responder lever.

5. A torque wrench according to claim 4, wherein said responder and actuator levers are pivotal about the same axis.

6. A torque wrench according to claim 1, wherein said signal generating means includes means for generating an audible signal and further means for generating a visible signal.

7. A torque wrench according to claim 1, wherein said movable member is mounted on said bar and the other said member is mounted on an arm fixed to said head and extending laterally therefrom in substantially the same direction as said bar.

8. A torque wrench according to claim 1, wherein said circuit is contained within said handle and includes a battery power source also contained within said handle.

9. A torque wrench including a reaction bar, a work engaging head secured to one end of said bar, an arm secured to said head and extending laterally therefrom in substantially the same direction as said bar, an electrical circuit carried by said bar and including signal generating means, an actuator switch operable to close said circuit and thereby cause said signal generating means to generate a signal, means urging said switch towards a circuit closed position, blocking means operable to prevent movement of said switch into the circuit closed position, a triggering member mounted on said arm, a responder member pivotally mounted on said bar so as to be engagable with said triggering member and thereby caused to pivot relative to said bar towards a signal generating position at which it renders said blocking means inoperable, said engagement of the members occurring as a result of said bar flexing in response to torque applied to said head through said bar, and said actuator switch is operative to maintain the circuit closed until responder member is able to move back from said signal generating position.

10. A torque wrench according to claim 9, wherein lost motion means is provided between said responder member and said blocking means so that said responder member moves part way towards said signal generating position without affecting the operation of said blocking means.

11. A torque wrench according to claim 9, wherein said triggering member is adjustably mounted on said arm to permit variation of the degree of said flexing necessary for said responder member to be moved into said signal generating position, and scale means is associated with said triggering member and said arm to enable the position of said triggering member to be indexed.

12. A torque wrench according to claim 11, wherein said triggering member is slidably mounted on said arm, clamp means is operable to releasably secure said triggering member in a selected position, and a ramp surface of said triggering member slopes relative to its direction of sliding movement and is engagable by said responder member.

* * * * *